US007597297B2

(12) United States Patent
Isfeld et al.

(10) Patent No.: US 7,597,297 B2
(45) Date of Patent: Oct. 6, 2009

(54) GENERAL PURPOSE, ELONGATED HORIZONTAL SUPPORT SYSTEM

(76) Inventors: Christopher Isfeld, 13331 Sylvester Road, Mission, B.C. (CA) V2V 4J1; Stephen Lawson, 1947 Ocean Park Road, Surrey, B.C. (CA) V4A 3M2

( * ) Notice: Subject to any disclaimer, the term of this patent is extended or adjusted under 35 U.S.C. 154(b) by 185 days.

(21) Appl. No.: 11/786,730

(22) Filed: Apr. 13, 2007

(65) Prior Publication Data

US 2007/0235612 A1 Oct. 11, 2007

(51) Int. Cl.
*A47H 1/14* (2006.01)

(52) U.S. Cl. ..... 248/251; 248/309.1; 211/105.1

(58) Field of Classification Search ..... 248/251, 248/544, 200.1, 200, 201, 214, 316.1, 309.1, 248/264, 221.11, 222.13, 224.31, 224.7, 248/254, 262, 267; 211/89.01, 105.1
See application file for complete search history.

(56) References Cited

U.S. PATENT DOCUMENTS 2,215,331 A * 9/1940 Marsh ..... 248/251
2,498,590 A * 2/1950 Straus ..... 248/264
4,700,918 A * 10/1987 Andrasko, Jr. ..... 248/251
5,402,977 A * 4/1995 Korfgen et al. ..... 248/309.1
6,595,478 B2 7/2003 Lee
6,651,830 B2 * 11/2003 Pan ..... 211/105.1
6,810,538 B2 * 11/2004 Ouyoung ..... 4/576.1
6,932,328 B2 8/2005 Shreiner et al.
7,111,336 B1 9/2006 Lai
7,195,218 B2 3/2007 James et al.
7,367,535 B2 * 5/2008 Lai ..... 248/251

* cited by examiner

*Primary Examiner*—Anita M King
(74) *Attorney, Agent, or Firm*—Frederick Kaufman, Inc.

(57) ABSTRACT

The system comprises a rod subassembly for suspending articles, supported at extremities by a holding subassembly. The former includes a hollow rod having along its length an upper recessed zone similar to a circular segment and incorporates at each lateral extremity a continuous, capturing recess extending towards an interior of the rod. A protection insert is placed on the zone and retained by the recesses. The rod is covered with longitudinal corrugations. The holding subassembly includes a bracket for attaching to an external recipient and a sleeve flange for supporting the rod and for interengaging with the bracket. The bracket includes a wedge-shaped element, while the sleeve flange has a flange with a recess complimentary to the foregoing element. By inserting the wedge-shaped element into the complementary recess, an interengagement between those parts which incorporate the former and the latter occurs.

6 Claims, 4 Drawing Sheets

GENERAL PURPOSE, ELONGATED HORIZONTAL SUPPORT SYSTEM

I. BACKGROUND OF THE INVENTION

1. Field of the Invention

The present invention relates, in general, to systems from which articles can be hung and, in particular, to a general purpose, elongated horizontal support system for positioning between and in engagement with vertically oriented, rigid, planar, opposed, recipient surfaces.

2. Description of the Prior Art

Elongated horizontal support systems, from which various articles can be suspended, of known designs and configurations are well known in the prior art. The elongated horizontal support systems, previously devised and utilized for the same purpose, are either known to consist basically of familiar, expected, and obvious structural configurations, or having complicated and cumbersome structures, as for example: US Patent Application Publication No. 2004/0178310, published on Sep. 16, 2004 under the title "Self Adhesive Shower Rod and Support" (inventor Marion) describes a shower rod having a first and a second U-shaped cradle supports. Each of the latter has a complimentary configuration to the shower rod and is attached to an adjacent vertical wall by an adhesive. The aforementioned combination has two important shortcomings: first, the attachment to the walls does not appear durable, and second, the system does not provide a reliable stability. Another example is U.S. Pat. No. 6,598,843 granted on Jul. 29, 2003 to Bell et al. for an "Extendable Bracket for Window Covering Components" that describes an assembly comprising an extendable bracket provided with a mounting base with a base plate and intended for supporting hardware components. The base plate has an attachment side for mounting to a surface and has a support side opposite the attachment side. A base support element extends from the support side of the base plate. A first extension part has a first body with a proximal end adjacent the mounting base and a first extension support element that extends from an opposite distal end of the first body.

The main disadvantage of the above assembly resides in the fact that it uses components with complicated configurations, not easy to manufacture and, therefore, relatively costly. Yet another example is U.S. Pat. No. 6,494,426 granted on Dec. 17, 2002 to Wilks for a "Mounting System". In this patent is described a system comprising a cylindrical member having an interior surface and an exterior surface. The cylindrical member further includes a first end with a first edge and female threads formed in the interior surface adjacent to the first edge. The system further comprises a mounting plate having an interior face and an exterior face and a generally cylindrical, thin, outer circumference. The latter is provided with three arcuate concave regions, each about 60 degrees, equally spaced around the circumference. The mounting plate is also provided with three arcuate convex regions, each about 60 degrees, equally spaced around the circumference between the concave regions. The convex regions each has male threads adapted to releasably couple to the threads of the cylindrical member.

As can be seen, the foregoing patent discloses a relatively complicated solution.

II. SUMMARY OF THE INVENTION

Based on the above considerations regarding the prior art, it is considered that there is a need to improve the elongated horizontal support systems.

Thus, a first objective of the present invention is to enhance the versatility of the system.

Another objective of the present invention is to devise a durable system, capable of resisting damage during use.

Yet another objective of the present invention is to increase maneuverability of the system, rending it easy to assemble and disassemble.

Broadly stating, the general purpose, elongated, horizontal support comprises, in combination rod means for suspending articles, and means for holding each extremity of the rod means for suspending articles. The latter is provided at its top with means for protection extending along its length and having lateral extremities; and adjacent the lateral extremities with recess means for capturing the lateral extremities.

The means for holding each extremity of the rod means for suspending articles including bracket means for attaching the latter to external, opposed, vertically oriented, recipient surfaces; and sleeve flange means for interengaging with the bracket means for attaching and for receiving an extremity of the means for holding.

The bracket means for attaching is provided with means for wedging, while the sleeve flange means for interengaging is provided with complementary means for wedging, so that the former and the latter, when assembled together for use, are firmly interengaged.

In one aspect of the present invention, the general purpose, elongated, horizontal support system, comprises a rod subassembly supported at each opposed extremity by a holding subassembly.

The rod subassembly, from which various articles can be suspended, includes an elongated, hollow rod having along its length an upper recessed zone similar in cross section to a circular segment. The latter is provided at each lateral extremity with a continuous, capturing recess extending towards an interior of the elongated, hollow rod. The latter, except the upper recessed zone is provided lengthwise, on its external surface, with longitudinal corrugations. An upper protection insert having such a size and a shape as to fill the upper recessed zone being provided at each lateral extremity with a longitudinal, conveniently chosen profile for interengaging with the continuous, capturing recess. The upper protection insert is longitudinally inserted by a sliding or snap fit, so as to be removably retained in the continuous, capturing recesses.

The holding subassembly incorporating an end attaching bracket, adaptable to be secured to a wall or a furniture's vertical panel, and a sleeve flange, the former and the latter being so designed, as to be readily and firmly interengageable.

The attaching bracket basically includes a wedge-shaped element extending downwardly and outwardly into an annular segment, somewhat larger than a lower larger part of the wedge-shaped element. The latter has a configuration similar to a trapezoid defined laterally by a pair of identical, outwardly slopping sides, each one of the latter outwardly ending into a chamfered towards the back edge. The annular segment has at each side a lateral extremity adjacent to a chamfered towards the back edge, so forming a horizontal contacting surface. The wedge-shaped element ends at its bottom larger side, with a flat contacting zone, the attaching bracket being also provided with means for fixing on and to a vertical recipient surface.

The sleeve flange includes a sleeve and a flange. The sleeve has its internal configuration so profiled as to correspond to an external configuration of the elongated, hollow rod (with said upper protection insert attached to the latter).

The flange extends outwardly from an extremity of the sleeve and is defined by a peripheral line extending outwardly beyond an external configuration of the sleeve and surrounds the latter except a bottom zone used for locating the annular segment.

The flange is centrally provided with a wedge-shaped recess having slopping margins directed downwardly and outwardly. The slopping margins end with chamfered lips backwardly directed. The flange is conveniently recessed as to be able to complimentarily interengage the wedge-shaped element, thus when the latter is vertically and downwardly inserted and, thus, received into the wedge-shaped recess, the chamfered towards the back edges and the chamfered lips complimentarily and frictionally interengage, while the horizontal contacting surface and the flat contacting zone of the wedge-shaped element matingly engage corresponding areas provided in the wedge-shaped recess.

In another aspect of the present invention, the holding subassembly for use in a general purpose, elongated horizontal support system, the latter includes a rod subassembly, from which various articles can be suspended. The rod subassembly includes an elongated, hollow rod having along its length an upper recessed zone, substantially similar in cross section to a circular segment. The upper recessed zone is provided at each lateral extremity with a continuous, capturing recess extending towards an interior of the elongated, hollow rod. An upper protection insert has such a size and a shape as to fill the upper recessed zone. The upper protection insert is provided at each lateral extremity with a longitudinal, profile for interengaging with the continuous, capturing recess, the upper protection insert being longitudinally inserted by a sliding or snap fit, so as to be removably retained in the continuous, capturing recesses.

The holding subassembly comprises an end attaching bracket, adaptable to be secured to a wall or a furniture's vertical panel, and a sleeve flange, the former and the latter being so designed, as to be readily and firmly interengageable;

The attaching bracket basically includes a wedge-shaped element extending outwardly into an annular segment, somewhat larger than an upper larger part of the wedge-shaped element, the latter having a configuration similar to a trapezoid defined laterally by a pair of identical, inwardly slopping sides. Each one of the latter outwardly ends into a chamfered towards the back edge. The annular segment has at each side a lateral extremity adjacent to a chamfered towards the back edge, thus forming a horizontal contacting surface. The wedge-shaped element ends at its top narrow side, with a flat contacting zone. The attaching bracket is also provided with means for fixing on and to a vertical recipient surface;

The sleeve flange includes a sleeve and a flange, the sleeve having its internal configuration so profiled as to correspond to an external configuration of the elongated, hollow rod with the upper protection insert attached to the latter.

The flange extends outwardly from an extremity of the sleeve and is defined by a peripheral line extending outwardly beyond an external configuration of the sleeve and surrounds the latter, except a top zone used for locating the annular segment;

The flange is centrally provided with a wedge-shaped recess having slopping margins directed downwardly and outwardly. The slopping margins end with chamfered lips backwardly directed. The flange is conveniently recessed as to be able to complimentarily interengage the wedge-shaped element, thus when the latter is vertically and downwardly inserted and, thus, received into the wedge-shaped recess, the chamfered towards the back edges and the chamfered lips complimentarily and frictionally interengage, while the horizontal contacting surface and the flat contacting zone of the wedge-shaped element matingly engage corresponding areas provided in the wedge-shaped recess.

In a last aspect of this invention, the holding means further comprises, when the rod means for suspending articles includes an elongated hollow rod that together with an upper protection insert attached to it, basically have a circular cross section, a modified flange of a circular shape incorporating a pair of spaced protuberances projecting from a surface of said modified flange that faces the elongated hollow rod having said circular cross section. The pair of spaced protuberances are so located that each of them abuts against an adjacent recess means for capturing lateral extremities of the upper protection insert, namely a wall of the means for capturing. An interaction between the pair of spaced protuberances and adjacent walls of the recess means for capturing prevents a rotation of the elongated hollow rod with respect to the holding means.

III. BRIEF DESCRIPTION OF THE DRAWINGS

FIG. 1 A illustrates a side elevation view of the support system according to the present invention;

FIG. 1 B is a perspective view of FIG. 1A;

Figure 1A:
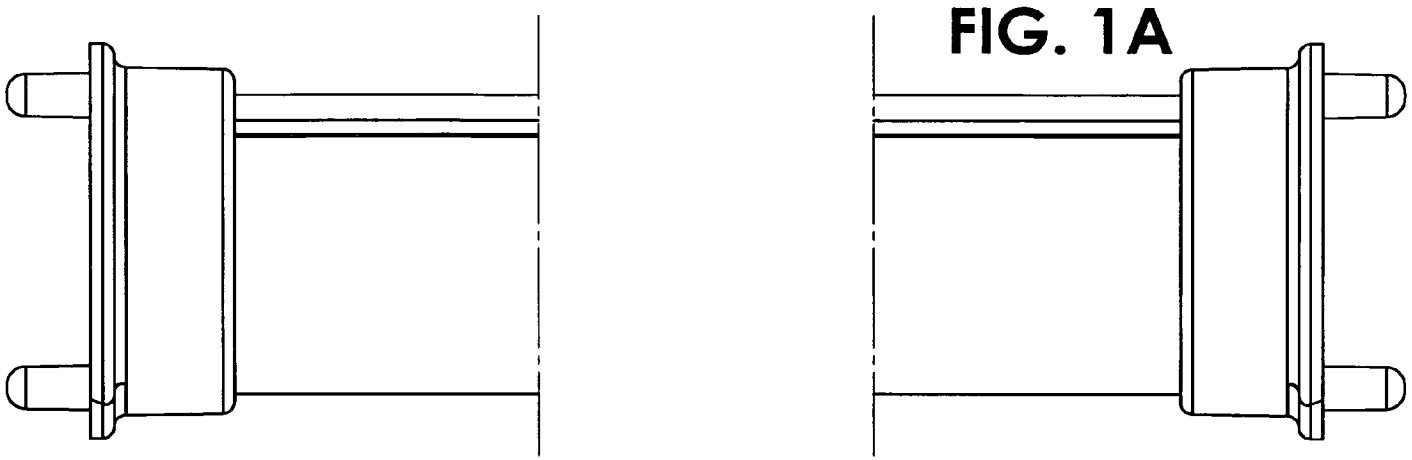
Figure 1B:
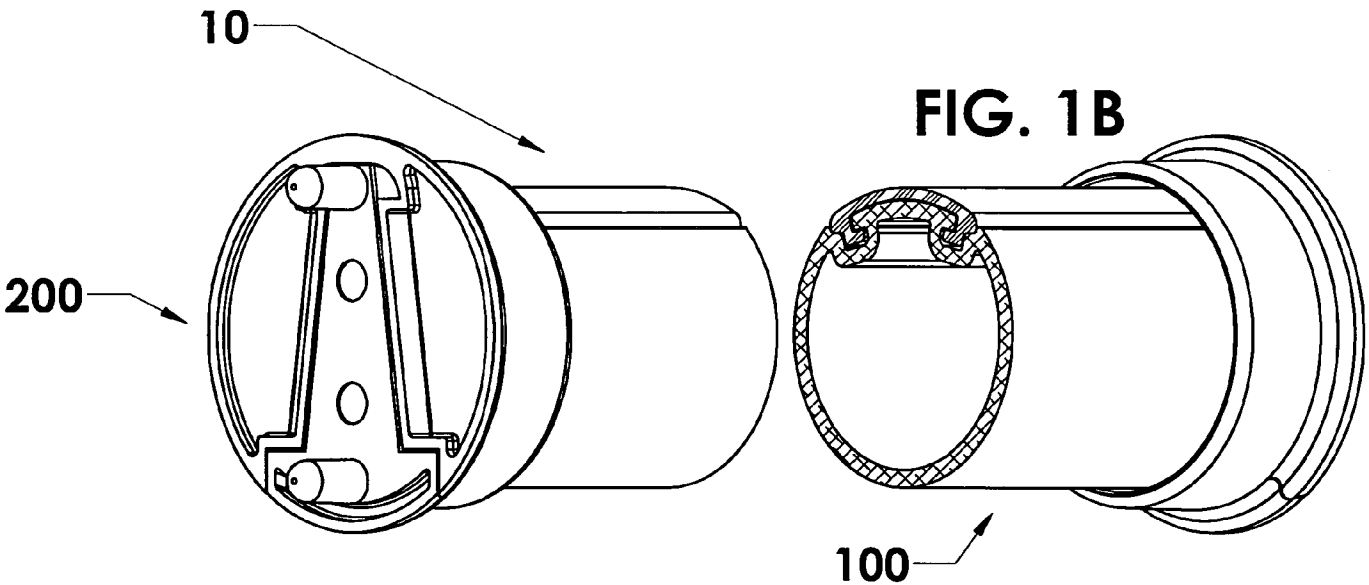
Figures 2, 3, 4:
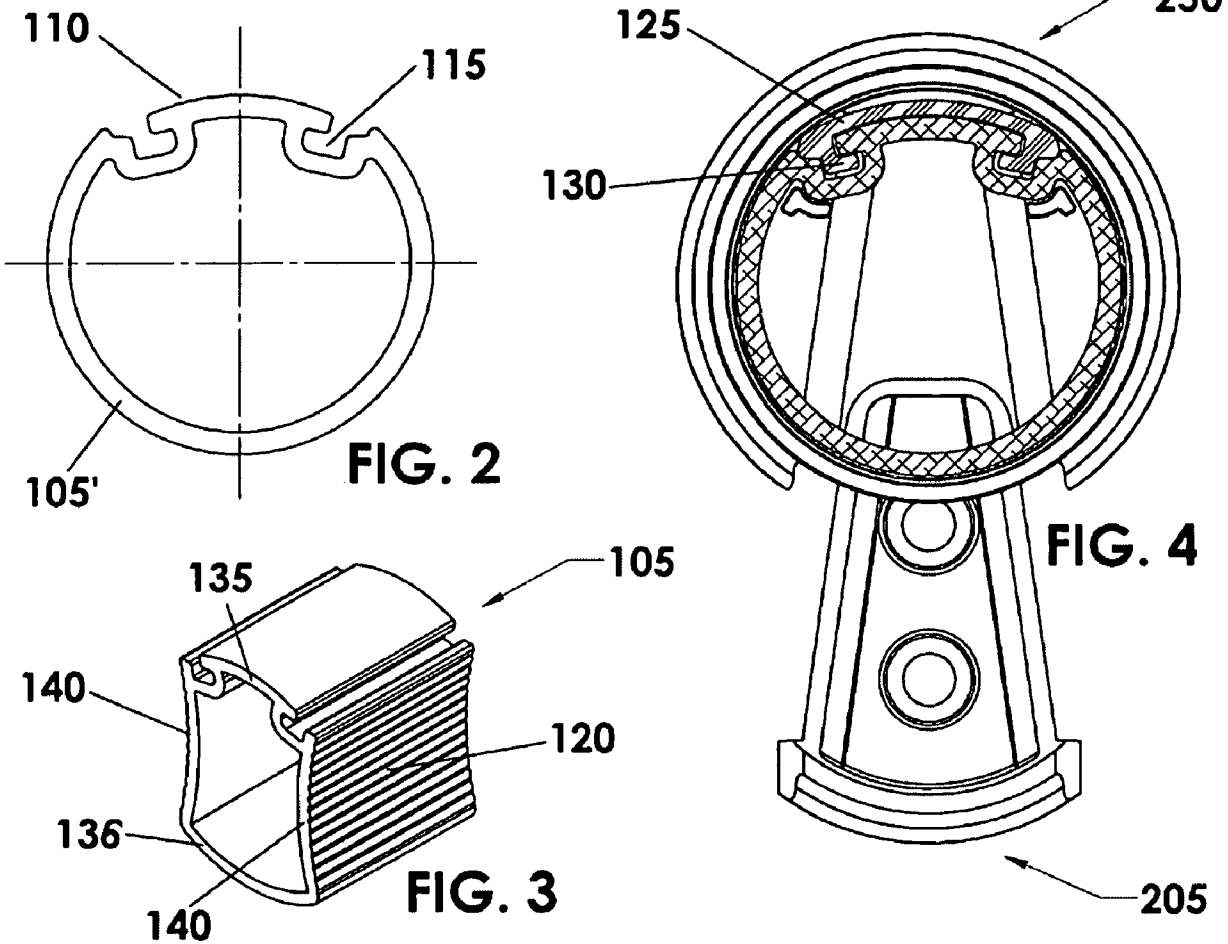
FIG. 2 is an elevation side view of an elongated hollow rod having a circular cross section.
FIG. 3 is a perspective view of an elongated hollow rod provided with a quadrilateral cross section and longitudinal corrugations.
FIG. 4 illustrates a holding subassembly in an attaching-detaching movement.
Figure 5B:
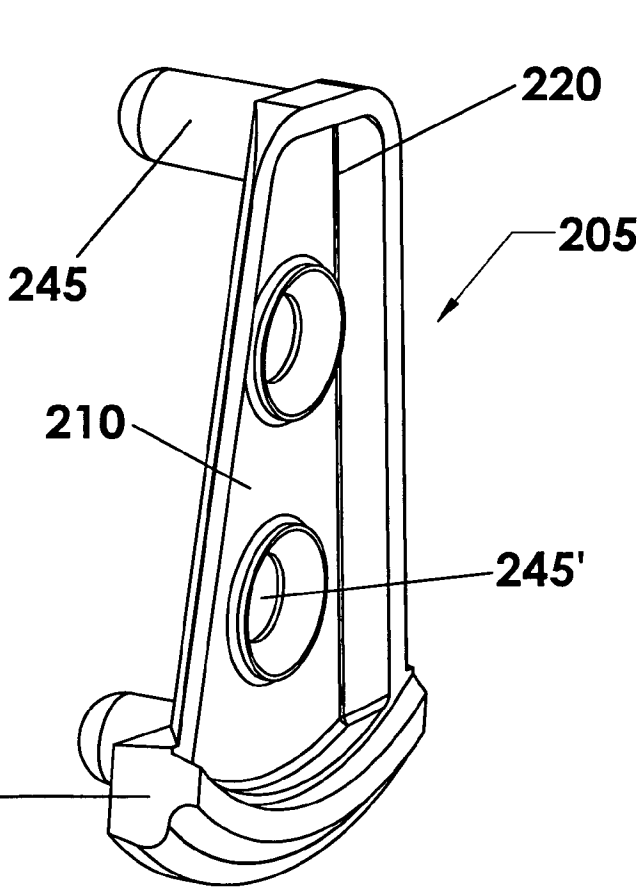
Figure 5A:
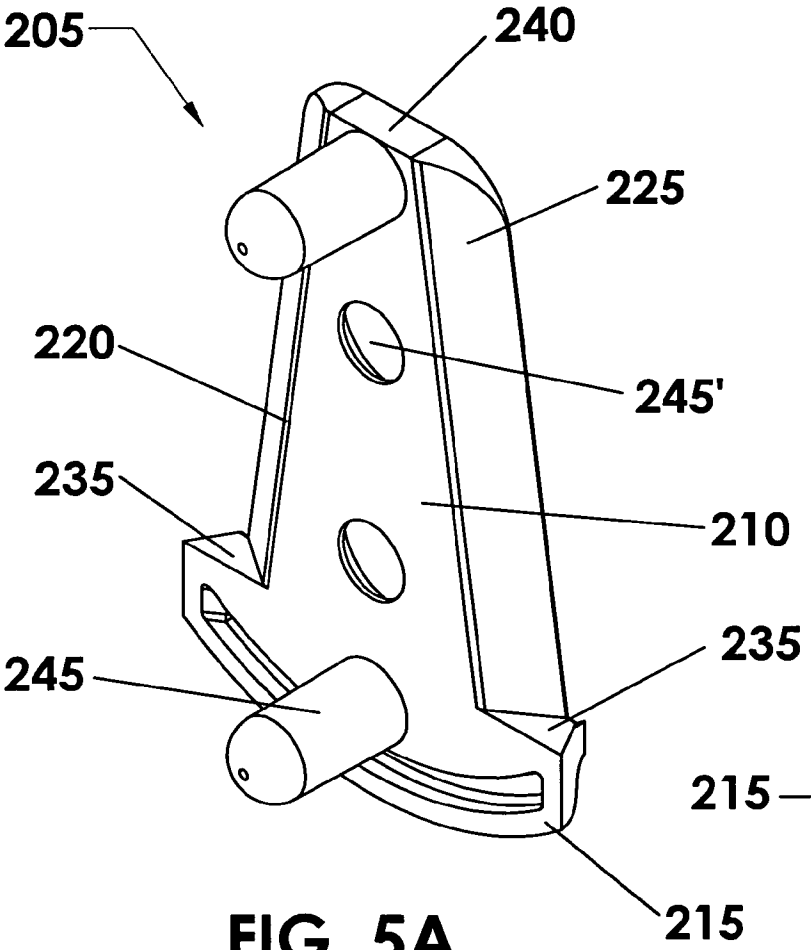
Figure 6B:
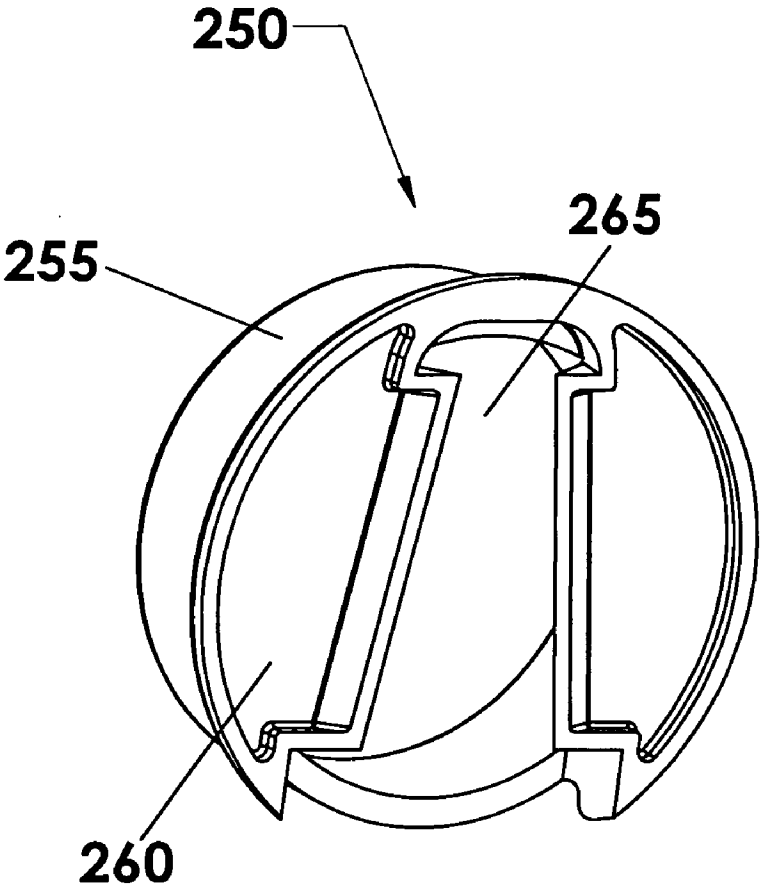
Figure 6A:
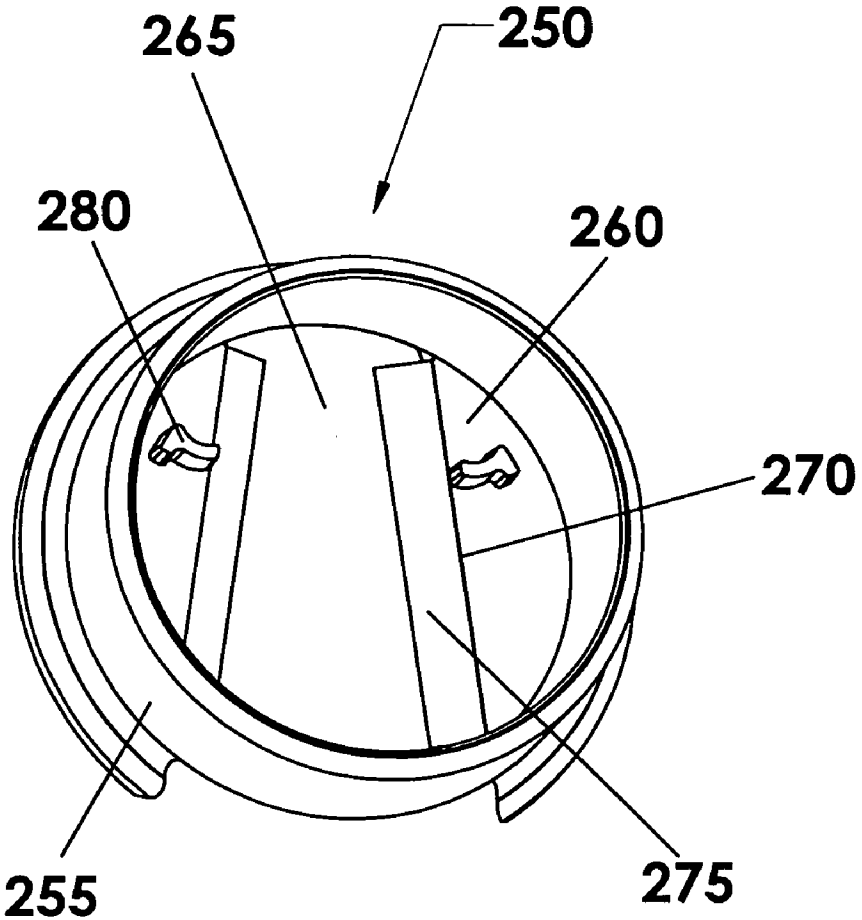

FIG. 5 A is a perspective view of an attaching bracket showing its back side;

FIG. 5 B is a perspective view of an attaching bracket showing its front side;

FIG. 6 A is a perspective view of a sleeve flange showing its front side; and FIG. 6 B is a perspective view of a sleeve flange showing its back side.

IV. DESCRIPTION OF A PREFERRED EMBODIMENT

Before describing in detail at least one embodiment of the present invention, it is to be understood that the invention is not limited to the specific structure of the components and to the arrangements of the latter as set forth in the forthcoming disclosure and illustrated in the accompanying drawings. The invention can be materialized in other embodiments and also carried out in various ways. Also, it is to be understood that the wording and specific terminology used herein should not be considered as limiting. Accordingly, all suitable modifications and equivalents may be resorted to, fall within the scope of the present invention.

A general purpose, elongated, horizontal support system 10, according to the present invention, comprises a rod subassembly 100 supported at each opposed extremity by a holding subassembly 200.

Rod subassembly 100, from which various articles can be suspended, includes an elongated, hollow rod 105, made usually of aluminium and having along its length an upper recessed zone 110 similar in cross section to a circular segment, provided at each lateral extremity with a continuous, capturing recess 115 extending towards an interior of elongated, hollow rod 105. The latter, except upper recessed zone 110, is provided lengthwise, on its external surface, with longitudinal corrugations 120.

Alternatively, a smooth continuous surface substitutes for longitudinal corrugations 120. An upper protection insert 125, made usually of extruded PVC, has such a size and a shape as to fill upper recessed zone 110. Upper protection insert 125 has at each lateral extremity a longitudinal, conveniently chosen profile 130 for interengaging with continuous, capturing recess 115. Upper protection 125 insert is longitudinally inserted by a sliding fit, so as to be removably retained in continuous, capturing recesses 115.

Elongated, hollow rod 105, in one variant of this invention, has basically, in a transversal cross section, a quadrilateral shape with a) convex upper and lower surfaces 135 and 136, convex upper surface 135 being a mirror image of the convex lower surface 136 and, obviously, vice versa; and b) concave side surfaces 140, wherein also one is the mirror image of the other one. Convex upper and lower surfaces 135 and 136 are relatively shorter than concave side surfaces 140.

In another variant of this invention, elongated hollow rod 105' with its upper protection insert 125 attached to it has, basically, a circular cross section.

In the foregoing variants, both elongated hollow rods 105 and 105' are provided with an upper recessed zone 110 for use with upper protection 125.

Always a distance between a longitudinal axis of symmetry of elongated hollow rods 105, 105' and the top and the bottom of those rods, with upper protection 125 in place, must be equal for easy attach into and detach from each holding subassembly 200.

Holding subassembly 200 incorporates an end attaching bracket 205, adaptable to be secured to a wall or a furniture's vertical panel (both not shown), and a sleeve flange 250. The former and the latter are designed, as could be seen in the forthcoming disclosure, to be readily and firmly interengageable.

Attaching bracket 205 basically includes a wedge-shaped element 210 extending downwardly and laterally into an annular segment 215, somewhat larger than a lower larger part of wedge-shaped element 210. The latter has a configuration similar to a trapezoid defined laterally by a pair of identical, outwardly slopping sides 220, each one of the latter outwardly ending into a chamfered towards the back edge 225.

Annular segment 215 has at each side a lateral extremity that is adjacent to a chamfered towards the back edge 225 and forms a horizontal contacting surface 235 whose use will be further disclosed.

Wedge-shaped element 210 ends at its top narrow side, with a flat contacting zone 240 whose intended use will be further disclosed.

Attaching bracket 205 has a pair of vertically spaced pegs 245 projecting from its external surface for positioning on and fixing into a furniture panel provided with compatible perforations (not shown).

Alternatively, instead of the pair of vertically spaced pegs 245, use can be made of chamfered holes 245' for countersunk screws (also not shown), the latter being adapted to extend through these chamfered holes 245' and be attached to a wall or a panel.

Many lateral panels used in furniture are provided with one ore more vertical columns of equally spaced perforations characterised by a preestablished conventional/standard/diameter and a distance between each two consecutive perforations.

The diameter and the distance between the pair of vertically spaced pegs 245 are so commensurate with the above dimensions, that a light-press fit could be achieved.

Sleeve flange 250 includes a sleeve 255 and a flange 260. Sleeve 255 has its internal configuration so profiled as to correspond to an external configuration/cross-section/of elongated, hollow rod 105 (105'), with upper protection insert 125 attached to the latter. Each end of each of the latter is inserted into sleeve 255 by means of a sliding fit.

Flange 260 extends outwardly from an extremity of sleeve 255. Sleeve flange 250 is unitarily formed by flange 260 and sleeve 255. Flange 260, being defined by a peripheral line extending outwardly beyond external configuration of sleeve 255, surrounds the latter, except a bottom zone used for locating annular segment 215.

Flange 260 is centrally provided with a wedge-shaped recess 265 having slopping margins 270 directed downwardly and outwardly. Slopping margins 270 end with chamfered lips 275 backwardly directed.

Flange 260 is conveniently recessed as to be able to complimentarily interengage wedge-shaped element 210. Thus, when the latter is vertically and downwardly inserted and, thus, received into wedge-shaped recess 265, chamfered towards the back edges 225 and chamfered lips 275 complimentarily and frictionally interengage, while horizontal contacting surface 235 and flat contacting zone 240 of wedge-shaped element 210 matingly engage corresponding areas provided in wedge-shaped recess 265.

Flange 260 when used with elongated hollow rod 105' of circular cross section has also a circular shape and is provided with a pair of spaced protuberances 280 projecting from that surface of flange 260 which faces elongated hollow rod 105'. The pair of spaced protuberances 280 are so located that each of them abuts against an adjacent continuous, capturing recess 115, more precisely a wall of the latter. Elongated hollow rods 105 and 105' have a bore completely therethrough, through which a pair of continuous, capturing recesses 115 extend. The interaction between the pair of spaced protuberances 280 and contiguous walls of continuous, capturing recesses 115 prevents a rotation of elongated hollow rod 105'.

As to the manner of usage and operation of the present invention, when elongated, hollow rod 105(105') has a length equal to a distance, with minimum clearance, between internal faces of two opposed wedge-shaped elements 210, previously secured to walls or panels, the following takes place:

to detach elongated, hollow rod 105(105') together its pair of sleeve flanges 250 from a working position, the former and the latter, as an unit, are lifted vertically; consequently, wedge-shaped recesses 265, provided in the pair of sleeve flanges 250, cease their interengagement with the pair of corresponding wedge-shaped elements 210; and to position elongated, hollow rod 105(105') together with the pair of sleeve flanges 250 into a working position, the former and the latter, as an unit, are inserted vertically and downwardly, so that, as mentioned above, chamfered towards the back edges 225 and chamfered lips 275 complimentarily and frictionally interengage, while horizontal contacting surface 235 and flat contacting zone 240 of wedge-shaped element 210 matingly engage corresponding areas provided in wedge-shaped recess 265. Other variants of the manner of attachment and detachment should be apparent from the description of the preferred embodiment.

Alternatively to elongated hollow rods 105 and 105', use can be made of elongated hollow rods without continuous, capturing recesses 110 and, consequently, without upper protection inserts 125.

What we claim is:

1. A general purpose, elongated, horizontal support comprising, in combination rod means for suspending articles; and means for holding longitudinal extremities of said rod means for suspending articles, said rod means for suspending articles being provided at its top with means for protection extending along the length of said rod means for suspending articles and having lateral extremities; and said rod means for suspending articles further having recess means for capturing said lateral extremities;

said means for holding longitudinal extremities of said rod means for suspending articles including bracket means for attaching said rod means for suspending articles to external, opposed, vertically oriented, recipient surfaces; and sleeve flange means for interengaging with said bracket means for attaching and for receiving said longitudinal extremities of said road means for suspending articles;

said bracket means for attaching being provided with means for wedging, while said sleeve flange means for interengaging being provided with complementary means for wedging, so that said bracket means for attaching and said sleeve flange means for interengaging, when assembled together for use, are firmly interengaged.

2. The support of claim 1, wherein said means for holding comprise, when said rod means for suspending articles include an elongated, hollow rod and said means for protection include an upper protection insert, and when said elongated, hollow rod is assembled with said upper protection insert, their cross section is basically circular;

said sleeve flange means for interengaging having a flange, which, when used with said elongated, hollow rod assembled with said upper protection insert and have their said cross section basically circular, is also circular and provided with a pair of spaced protuberances projecting from a surface of said flange that faces said elongated, hollow rod, said pair of spaced protuberances being so dimensioned and located that it interacts with said recess means for capturing said lateral extremities of said upper protection insert.

3. A general purpose, elongated, horizontal support assembly, comprising a rod subassembly supported at opposed extremities by a pair of holding subassemblies, said rod subassembly, from which various articles can be suspended, including an elongated, hollow rod having, along its length, an upper recessed zone similar in cross section to a circular segment, said upper recessed zone, being flanked by a pair of continuous, capturing recesses; said elongated, hollow rod, except said upper recessed zone, being provided lengthwise, on its external surface, with longitudinal corrugations; an upper protection insert, having such a size and a shape as to fill said upper recessed zone, is provided at its lateral extremities with longitudinal, conveniently chosen profiles for interengaging with said continuous, capturing recesses, said upper protection insert being longitudinally inserted by a sliding fit, so as to be removably retained in said continuous, capturing recesses;

said pair of holding subassemblies incorporating end attaching brackets, adaptable to be secured to a pair of opposed walls or to a pair of opposed furniture vertical panels, and sleeve flanges; said end attaching brackets and said sleeve flanges being so designed, as to be readily and firmly interengageable; said attaching brackets basically including a wedge-shaped element extending downwardly and laterally into an annular segment, somewhat larger than a lower larger part of said wedge-shaped element; said wedge-shaped element having a configuration similar to a trapezoid defined laterally by a pair of identical, outwardly slopping sides, outwardly ending into a pair of chamfered towards the back edges; said annular segment having lateral extremities, adjacent to said pair of chamfered towards the back edges, and forming a pair of horizontal contacting surfaces; said wedge-shaped element ending at its top narrow side with a flat contacting zone, said attaching brackets being provided as well with means for fixing on and to vertical recipient surfaces of said pair of opposed walls or to said pair of opposed furniture vertical panels;

said sleeve flanges including sleeves and flanges, said sleeves having an internal configuration so profiled as to correspond to an external configuration of said elongated, hollow rod with said upper protection insert attached;

said flanges, extending outwardly from an extremity of said sleeves, are defined by a peripheral line extending outwardly, beyond an external configuration of said sleeves, and are intended for surrounding said sleeves, except a bottom zone used for locating said annular segment;

said flanges being also centrally provided with a wedge-shaped recess having slopping margins directed downwardly and outwardly and provided with chamfered lips backwardly directed; said flanges being conveniently recessed as to be able to complimentarily interengage said wedge-shaped elements, thus, when said wedge-shaped elements are vertically and downwardly inserted and, thus, received into said wedge-shaped recesses, said chamfered towards the back edges and said chamfered lips complimentarily and frictionally interengage, while said horizontal contacting surfaces and said flat contacting zones of said wedge-shaped elements matingly engage corresponding areas provided in said wedge-shaped recesses.

4. The support of claim 3, wherein when said elongated, hollow rod together with said upper protection insert attached to it have a circular cross section, said flanges are also circular and each one of them is provided with a pair of spaced protuberances projecting from a surface of said flanges that faces said elongated, hollow rod;

said pair of spaced protuberances being so dimensioned and located that each one of them abuts against one of said continuous, capturing recesses that is adjacent to it.

5. A holding subassembly, for use in a general purpose, elongated horizontal support assembly, comprising a rod subassembly, from which various articles can be suspended, including an elongated, hollow rod having along its length an upper recessed zone, substantially similar in cross section to a circular segment, said upper recessed zone being flanked by a pair of continuous, capturing recesses; an upper protection insert, having such a size and a shape as to fill said upper recessed zone, is provided at its lateral extremities with longitudinal, conveniently chosen profiles for interengaging with said continuous, capturing recesses, said upper protection insert being longitudinally inserted by a sliding fit, so as to be removably retained in said continuous, capturing recesses;

said holding subassembly, used separately at both extremities of said rod subassembly, comprising an end attaching bracket, adaptable to be secured to a wall or a furniture's vertical panel, and a sleeve flange, said end attaching bracket and said sleeve flange being so designed, as to be readily and firmly interengageable;

said attaching bracket basically including a wedge-shaped element extending downwardly and laterally into an annular segment, somewhat larger than a lower larger part of said wedge-shaped element; said wedge-shaped element having a configuration similar to a trapezoid defined laterally by a pair of identical, outwardly slopping sides, outwardly ending into a pair of chamfered towards the back edges; said annular segment having lateral extremities, adjacent to said pair of chamfered towards the back edges, and forming a pair of horizontal contacting surfaces; said wedge-shaped element ending at its bottom larger side, with a flat contacting zone;

said attaching bracket being also provided with means for fixing on and to a vertical recipient surface;

said sleeve flange including a sleeve and a flange, said sleeve having its internal configuration so profiled as to correspond to an external configuration of said elongated, hollow rod, when said upper protection insert is attached to said elongated, hollow rod;

said flange extending outwardly from an extremity of said sleeve and, being defined by a peripheral line extending outwardly beyond an external configuration of said sleeve, surrounds said sleeve, except a bottom zone used for locating said annular segment;

said flange being centrally provided with a wedge-shaped recess having slopping margins directed downwardly and outwardly; said slopping margins ending with chamfered lips backwardly directed; said flange being conveniently recessed as to be able to complimentarily interengage said wedge-shaped element, when the latter is vertically and downwardly inserted and, thus, received into said wedge-shaped recess, said chamfered towards the back edges and said chamfered lips complimentarily and frictionally interengage, while said horizontal contacting surface and said flat contacting zone of said wedge-shaped element matingly engage corresponding areas provided in said wedge-shaped recess.

6. The holding subassembly of claim 5, wherein when said elongated, hollow rod together with said upper protection insert attached to it have a circular cross section, said flange is also circular and provided with a pair of spaced protuberances projecting from a surface of said flange that faces said elongated, hollow rod; and said pair of spaced protuberances are so dimensioned and located that it interacts with said continuous, capturing recesses.

* * * * *